US009514708B2

(12) United States Patent
Sasaki et al.

(10) Patent No.: US 9,514,708 B2
(45) Date of Patent: Dec. 6, 2016

(54) IMAGE PROCESSING APPARATUS, PROJECTOR AND IMAGE PROCESSING METHOD

(71) Applicant: Seiko Epson Corporation, Tokyo (JP)

(72) Inventors: Hitoshi Sasaki, Shiojiri (JP); Hidehito Iisaka, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 140 days.

(21) Appl. No.: 13/721,571

(22) Filed: Dec. 20, 2012

(65) Prior Publication Data

US 2013/0162698 A1 Jun. 27, 2013

(30) Foreign Application Priority Data

Dec. 27, 2011 (JP) ..... 2011-285074

(51) Int. Cl.
*G09G 5/10* (2006.01)
*G09G 3/36* (2006.01)

(52) U.S. Cl.
CPC ..... *G09G 5/10* (2013.01); *G09G 3/3614* (2013.01); *G09G 3/3648* (2013.01); *G09G 3/36* (2013.01); *G09G 2320/0209* (2013.01); *G09G 2360/16* (2013.01)

(58) Field of Classification Search
CPC ..... G09G 2320/0209; G09G 2320/0276; G09G 2320/0295; G09G 2320/0626; G09G 3/36; G09G 3/3648; G09G 3/3614; G09G 2360/0209; G09G 5/10; G09G 3/18; G09G 2320/0214; G09G 2320/0219; H04N 5/21
See application file for complete search history.

(56) References Cited

U.S. PATENT DOCUMENTS

2004/0070590 A1* 4/2004 Lee et al. ..... 345/690
2004/0247199 A1* 12/2004 Murai et al. ..... 382/274
2007/0146281 A1* 6/2007 Hosihara ..... G09G 3/3614 345/96
2008/0211756 A1* 9/2008 Shiomi et al. ..... 345/87
2008/0218464 A1* 9/2008 Koyama ..... G09G 3/3648 345/89

(Continued)

FOREIGN PATENT DOCUMENTS

JP 2005-077508 A 3/2005
JP 2007-148054 A 6/2007

*Primary Examiner* — Jonathan Boyd
*Assistant Examiner* — Sardis F Azongha
(74) *Attorney, Agent, or Firm* — ALG Intellectual Property, LLC

(57) ABSTRACT

A driving device of a display apparatus includes a calculation unit which calculates a correction value to correct a gradation value of a pixel that is a correction target on the basis of n gradation values that corresponds to n pixels and a correction unit which corrects the gradation value of a pixel that is a correction target on the basis of the correction value and the calculation unit performs a first calculation in a case in which a gradation value among the n gradation values is included in a first range, performs a second calculation in a case in which a gradation value among the n gradation values is included in a second range, respectively performs the first calculation or the second calculation on the n gradation values, and calculates the correction value on the basis of the calculation results performed on the n gradation values.

14 Claims, 14 Drawing Sheets

(56) References Cited

U.S. PATENT DOCUMENTS

| | | | | |
|---|---|---|---|---|
| 2009/0021537 | A1* | 1/2009 | Noguchi | G09G 3/3611 345/690 |
| 2009/0109210 | A1* | 4/2009 | Ito | G09G 3/3648 345/214 |
| 2010/0053145 | A1* | 3/2010 | Morita | 345/213 |
| 2011/0051006 | A1* | 3/2011 | Iisaka | G09G 3/3648 348/671 |
| 2011/0051007 | A1* | 3/2011 | Hosaka et al. | 348/673 |
| 2011/0205439 | A1* | 8/2011 | Iisaka et al. | 348/607 |

* cited by examiner

IMAGE PROCESSING APPARATUS, PROJECTOR AND IMAGE PROCESSING METHOD

BACKGROUND

1. Technical Field

The present invention relates to an image processing apparatus, a projector and an image processing method.

2. Related Art

In order to suppress flickering and degradation in active matrix type liquid crystal display apparatuses and the like, for example, the liquid crystal can be driven while alternately reversing the voltage that is applied to the liquid crystal between a positive voltage and a negative voltage. In this kind of liquid crystal, due to the effects of the parasitic capacitance between data lines (signal lines, data signal lines, source lines and source electrode lines) and pixel electrodes, the parasitic capacitance between each pixel electrode, the leakage current of the signal with respect to adjacent pixel electrodes and the like, the potentials of other pixel electrodes may change as a result of changes in the potentials of driving target pixel electrodes. Therefore, in a case in which a rectangular pattern or the like is displayed, the positive and negative polarities of changes in the potentials of pixel electrodes may differ and there are cases in which so-called vertical crosstalk, in which lines appear in the vertical direction, occurs due to a luminance difference between the surrounding area occurring at the top and bottom of the corresponding rectangle.

As a method of reducing the generation of this kind of crosstalk, JP-A-2005-77508 discloses a method of correcting the image data of each pixel so that the average potentials in a frame of the pixel electrodes is identical to the average potentials in a frame in a case in which it is assumed that changes in the potentials of the pixel electrodes that accompany changes in the potentials of data lines do not occur.

However, in this kind of method of uniform correction, there are cases in which it is not possible to suitably reduce the generation of crosstalk. More specifically, for example, there are cases in which, due to the characteristics of liquid crystal panels and the like, the changes of each gradation of the pixels is not linear and the corresponding changes increase or decrease according to the gradation, and thus it is not possible to sufficiently correct the corresponding changes with uniform correction.

SUMMARY

An advantage of some aspects of the present invention is that it provides an image processing apparatus, a projector and an image processing method capable of more suitably reducing the generation of crosstalk.

According to an aspect of the present invention there is provided an image processing apparatus of images displayed using a plurality of pixels which includes a calculation unit which, among pixel groups having common correction target pixels and data lines, determines a first correction value by performing a first calculation on a first pixel group that has a gradation value that is greater than or equal to a first defined value and determines a second correction value by performing a second calculation with a different weighting to that of the first calculation on a second pixel group that has a gradation value that is less than or equal to a second defined value; and a correction unit which corrects image data related to the correction target pixel on the basis of the first correction value and the second correction value.

A projector according to another an aspect of the present invention includes the image processing apparatus and a projection unit that projects images based on image data corrected by the correction unit.

According to still another aspect of the present invention there is provided an image processing method of images displayed using a plurality of pixels which, among pixel groups having common correction target pixels and data lines, determines a first correction value by performing a first calculation on a first pixel group that has a gradation value that is greater than or equal to a first defined value, determines a second correction value by performing a second calculation with a different weighting to that of the first calculation on a second pixel group that has a gradation value that is less than or equal to a second defined value and corrects image data related to the correction target pixel on the basis of the first correction value and the second correction value.

According to the present invention, the image processing apparatus or the like can more suitably reduce the generation of crosstalk by correcting image data related to a correction target pixel by performing a calculation with a weighting that is changed depending on the gradation value of the pixel group, which is the main cause of crosstalk generation.

In addition, the second defined value may be less than or equal to the first defined value. According to this configuration, the image processing apparatus or the like can perform a calculation which more suitably reflects the characteristics of the gradation value of each pixel group.

In addition, a positive polarity voltage on a high side of a reference voltage and a negative polarity voltage on a low side of a reference voltage may be alternately applied to the plurality of pixels in predetermined image processing units and the calculation unit may adjust the symbol in at least one of the first calculation and the second calculation depending on whether the application is the positive polarity voltage or the negative polarity voltage. According to this configuration, since it is possible to adjust correction data by adjusting the symbol depending on polarity, the image processing apparatus or the like can more suitably reduce the generation of crosstalk.

In addition, the calculation unit may include a first counting unit that counts a value that corresponds to the gradation value of the first pixel group and a second counting unit that counts a value that corresponds to the gradation value of the second pixel group. According to this configuration, the image processing apparatus or the like can more suitably reduce the generation of crosstalk by using counting units depending on the gradation value.

In addition, the calculation unit may include a first multiplication unit that determines the first correction value by multiplying a value counted by the first counting unit by a first coefficient and a second multiplication unit that determines the second correction value by multiplying a value counted by the second counting unit by a second coefficient that is different from the first coefficient. According to this configuration, the image processing apparatus or the like can more suitably reduce the generation of crosstalk by determining correction values by multiplying by a coefficient depending on the gradation value.

In addition, the first counting unit may count a value that corresponds to the gradation value of the first pixel group on the basis of correction data made to correspond to the gradation value and the value that corresponds to the gradation value or a function that outputs the value that corresponds to the gradation value depending on the input of the gradation value and the second counting unit may count a value corresponding to the gradation value of the second pixel group on the basis of the correction data or the function. According to this configuration, since it is possible to adjust values that correspond to the gradation value and adjust correction data by using correction data and functions, the image processing apparatus or the like can more suitably reduce the generation of crosstalk.

In addition, the gradation value may be a voltage value that indicates gradation. According to this configuration, since it is also possible to suitably perform correction in a case in which, for example, the change in the positive potential and the change in the negative potential differ in the same pixel in a case in which polarity reversal driving is performed by performing calculation using voltage values of gradation values, an image processing apparatus or the like can more suitably reduce the generation of crosstalk.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter embodiments in which the projector of an aspect the present invention is applied will be described with reference to the drawings. Additionally, the embodiments shown below do not limit the contents of the invention described in the claims. In addition, it is not essential that all of the configurations shown in the embodiments shown below are means for solving the invention described in the claims.

First Embodiment

Figure 1:
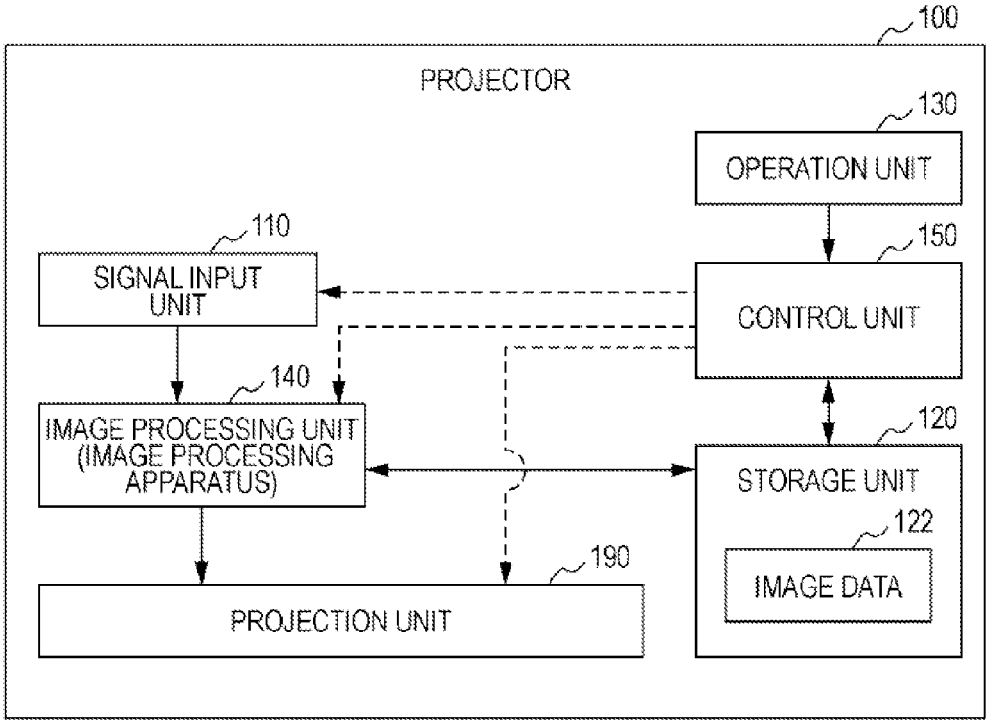
FIG. 1 is a functional block diagram of a projector in a first embodiment.

FIG. 1 is a functional block diagram of a projector 100 in the first embodiment. The projector 100 is configured to include a signal input unit 110 into which an image signal from an external apparatus is input, a storage unit 120 which stores image data 122 or the like based an image signal, an operation unit 130 which is an operation panel or the like into which operation instructions are input, an image processing unit (image processing apparatus) 140 which executes image processing on the image data 122, a control unit 150 which performs control depending on operation instructions or the like and a projection unit 190 which projects images after image processing.

Figure 2:
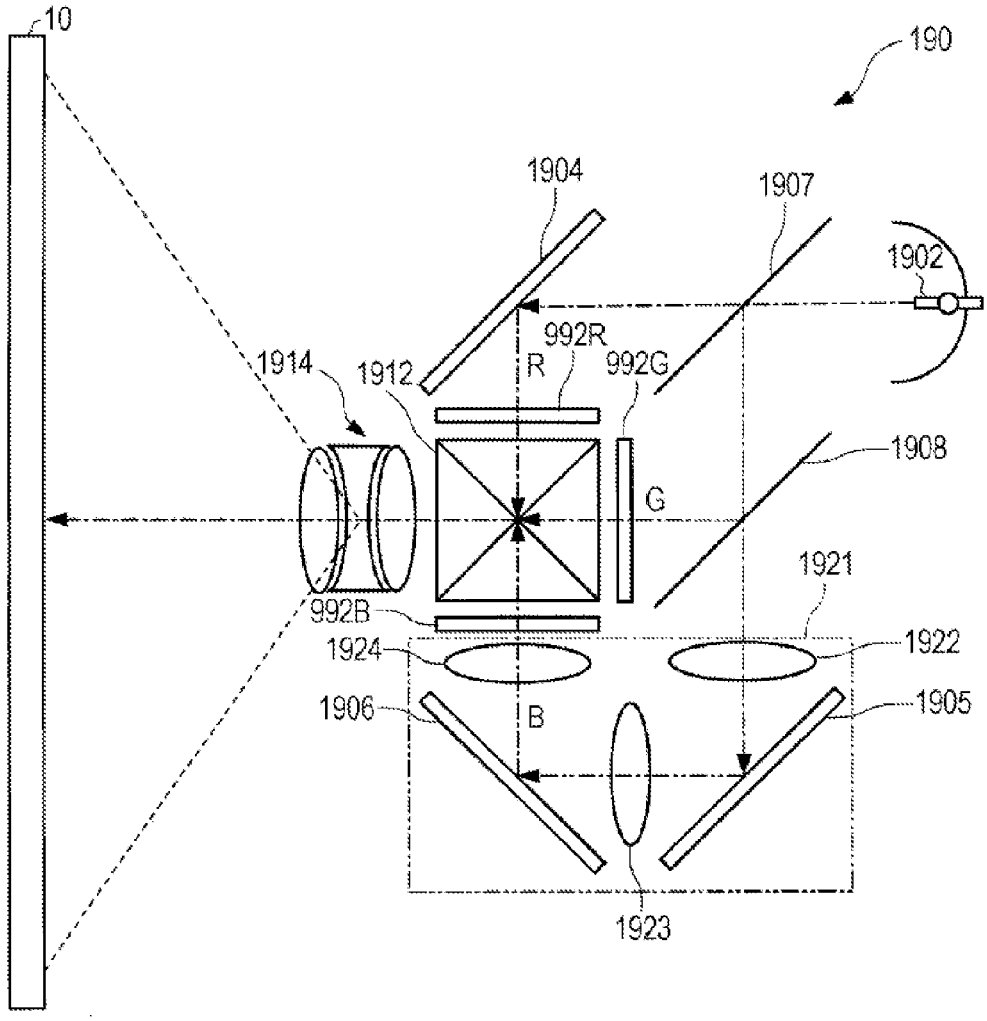
FIG. 2 is a view illustrating a configuration of a projection unit in the first embodiment.

FIG. 2 is a view illustrating a configuration of the projection unit 190 in the first embodiment. The projection unit 190 is configured to include a lamp unit 1902, mirrors 1904 to 1906, dichromatic mirrors 1907 and 1908 which are half mirrors, an incidence lens 1922 which configures a relay lens system 1921, a relay lens 1923 and an outgoing lens 1924, 3 liquid crystal panels 992R (red), 992G (green) and 992B (blue), a cross dichroic prism 1912, a lens unit 1914 and the like. Additionally, the relay lens system 1921 is provided to prevent the loss of light resulting from the light path of B light being longer than the light paths of the other primary colors.

As shown in FIG. 2, the lamp unit 1902 which is configured of a white light source such as a halogen lamp is provided inside the projector 100. Incident light emitted from the lamp unit 1902 is separated in the three primary colors, R, G and B by the 3 mirrors 1904 to 1906 and the 2 dichromatic mirrors 1907 and 1908, and is respectively lead to the liquid crystal panels 992R, 992G and 992B that correspond to each primary color.

Liquid crystal light bulbs that respectively correspond to the liquid crystal panels 992R, 992G and 992B are provided in 3 groups to correspond to each color, R, G and B in the projector 100. Further, image data 122 that corresponds to each color, R, G and B is stored in the storage unit 120. Additionally, in the present embodiment, the liquid crystal panels are panels that do not include backlights.

Light respectively modulated by the liquid crystal panels 992R, 992G and 992B is incident to the cross dichroic prism 1912 from 3 directions. Further, in the cross dichroic prism 1912, while R and B light is refracted by 90°, G light travels in a straight line. Therefore, after images of each color have been combined, a color image is projected on a screen 10 by the lens unit 1914.

Additionally, since light corresponding to each primary color R, G and B, is made to be incident using the dichromatic mirror 1908 or the like, it is not necessary to provide a color filter in the liquid crystal panels 992R, 992G and 992B. In addition, while the transmitted light of the liquid crystal panels 992R and 992B is projected after being reflected by the cross dichroic prism 1912, the transmitted light of the liquid crystal panel 992G is project as it is. Therefore, horizontal scanning directions in the liquid crystal panels 992R and 992B are opposite the horizontal scanning direction in the liquid crystal panel 992G, and the liquid crystal panels 992R and 992B are configured to display an image in which the left and right sides are reversed.

Figure 3:
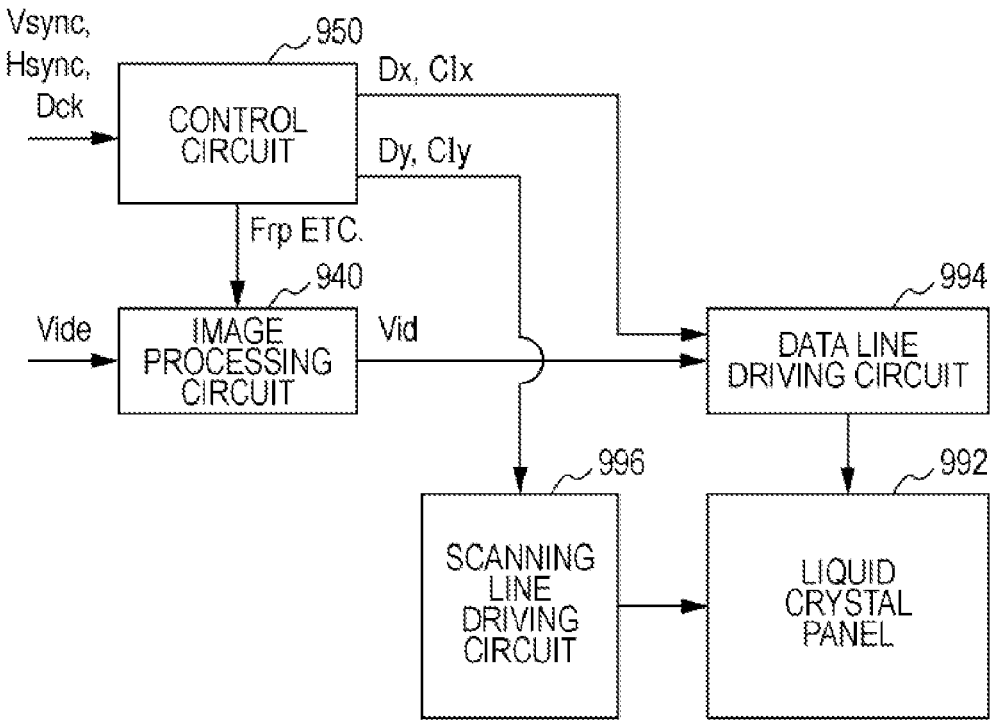
FIG. 3 is a circuit block diagram related to an image processing of a projector in the first embodiment.
Figure 4:
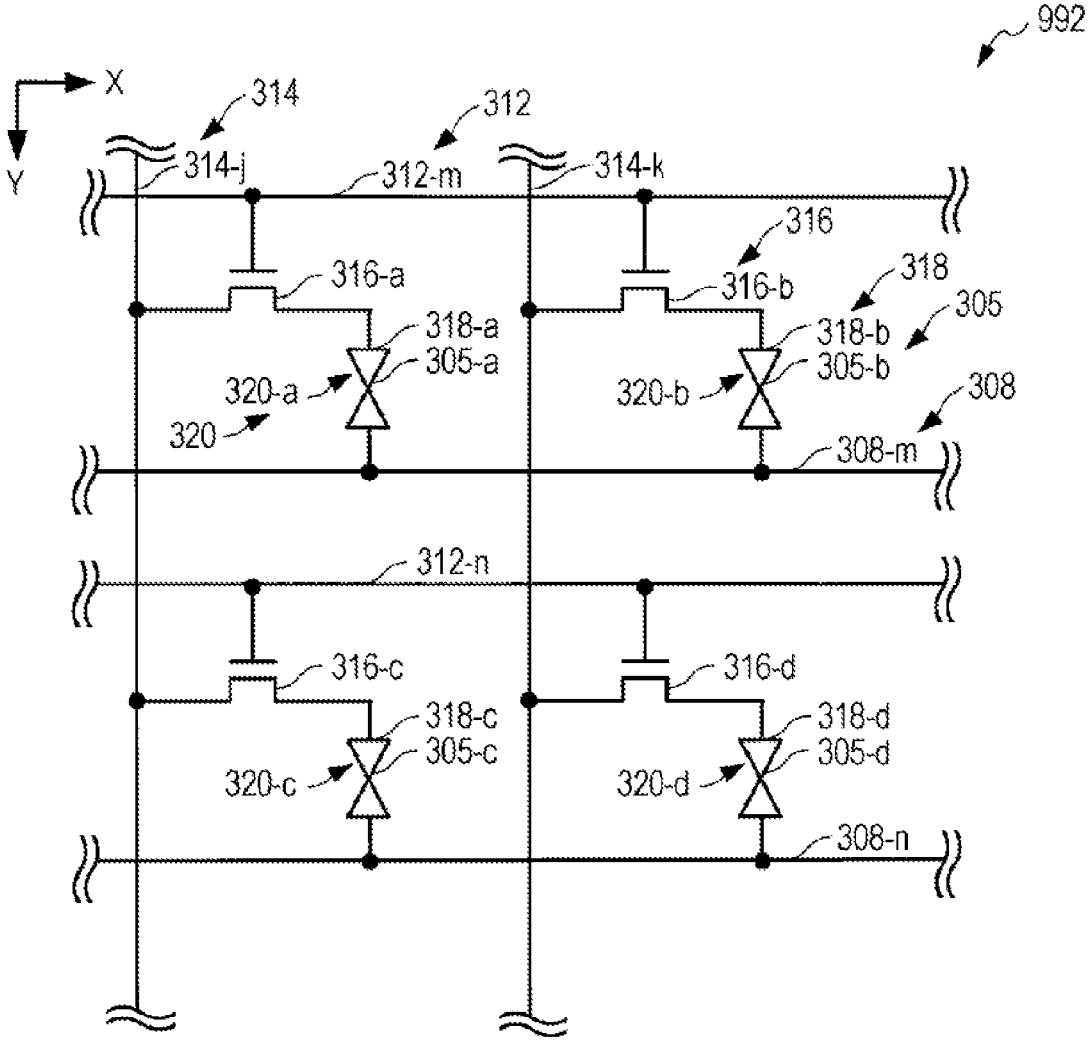
FIG. 4 is a view illustrating a configuration of a liquid crystal panel in the first embodiment.
Figure 5:
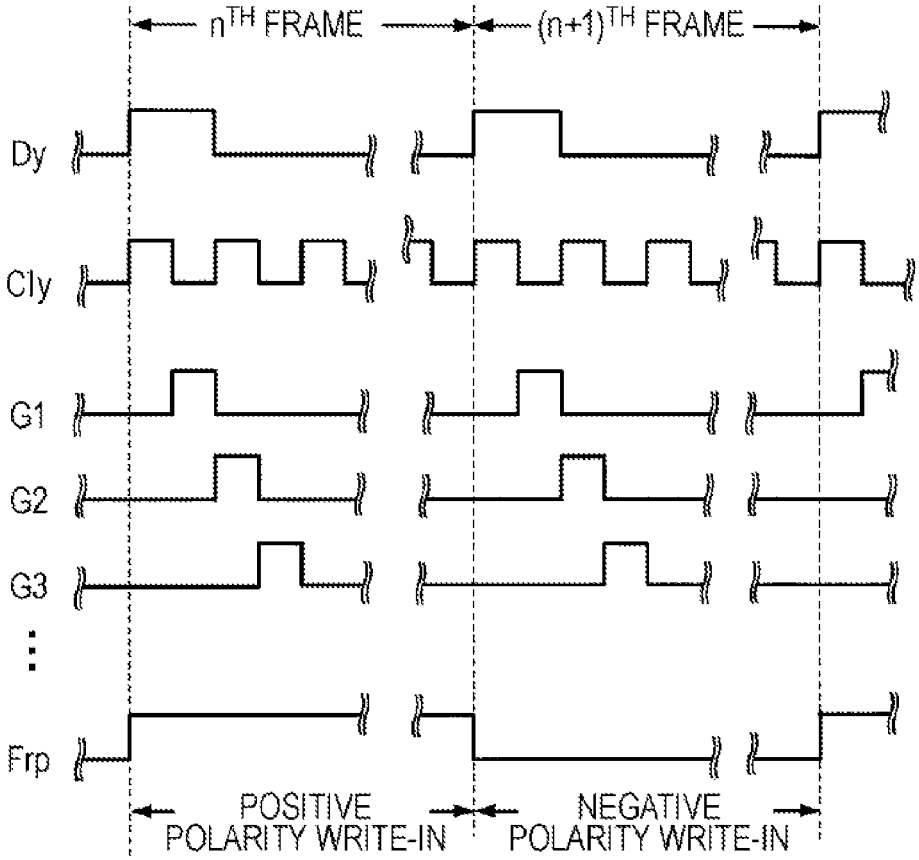
FIG. 5 is a view illustrating a driving method of the liquid crystal panel in the first embodiment.

Next, a circuit configuration and the like related to an image processing will be described. FIG. 3 is a circuit block diagram related to an image processing of a projector 100 in the first embodiment. In addition, FIG. 4 is a view illustrating a configuration of a liquid crystal panel 992 in the first embodiment. In addition, FIG. 5 is a view illustrating a driving method of the liquid crystal panel 992 in the first embodiment.

A control circuit 950 that configures the control unit 150, receives input of a vertical synchronizing signal Vsync, a horizontal synchronizing signal Hsync and a dot clock signal Dck based on the image data 122, outputs a polarity determination signal Frp or the like to an image processing circuit 940, and with respect to a data line driving circuit 994, in addition to outputting a start pulse Dx at the start timing of a horizontal scanning period, outputs a clock signal Clx with a cycle depending on the supply cycle of the dot clock signal Dck. Further, with respect to a scanning line driving circuit 996, in addition to outputting a start pulse Dy at the start timing of a vertical scanning period (frame period) defined by the vertical synchronizing signal Vsync, the control circuit 950 outputs a clock signal Cly having a cycle that is double the horizontal scanning period defined by the supply cycle of the horizontal synchronizing signal Hsync.

The image processing circuit 940 that configures the image processing unit 140 receives input of a digital format image signal Vide based on the image data 122, receives input of the polarity determination signal Frp or the like from the control circuit 950, performs correction and signal format conversion based on these signals and outputs an analogue format image signal Vid to the data line driving circuit 994.

The data line driving circuit 994 that drives the data lines of the liquid crystal panel 992 and the scanning line driving circuit 996 that drives the scanning lines of the liquid crystal panel 992 configure a portion of the projection unit 190. Here, the configuration of the liquid crystal panel 992 will be described using FIG. 4 which illustrates a portion (an area that illustrates the two lines and two rows of line m, line n, row j and row k) of the liquid crystal panel 992. The liquid crystal panel 992 is configured by sealing liquid crystal 305 in the gap between an element substrate and a counter substrate that have been bonded together.

In addition to a plurality of scanning lines 312 that extend in a lateral direction (X direction) being provided on the surface of the element substrate that faces the counter substrate, a plurality of data lines 314 that extend in a longitudinal direction (Y direction) are provided so that electrical insulation from each scanning line 312 is maintained. In addition, a group of an n-channel type TFT (thin film transistor) 316 and a rectangular, transparent pixel electrode 318 is provided on the element substrate to respectively correspond with each intersection between the scanning lines 312 and the data lines 314. A gate electrode of the TFT 316 is connected to a scanning line 312, a source electrode of the TFT 316 is connected to a data line 314, and a drain electrode of the TFT 316 is connected to the pixel electrode 318.

On the other hand, a transparent common electrode (omitted from the drawing) is provided across the entire surface of the surface of the counter substrate that faces the element substrate. A voltage Vcom is applied to the common electrode by a voltage supply circuit which has been omitted from the drawing.

In addition, a liquid crystal element 320 that sandwiches the liquid crystal 305 with the pixel electrodes 318 and the common electrode is provided to correspond with each intersection between the scanning lines 312 and the data lines 314. In the liquid crystal element 320, in addition to a differential voltage of the pixel electrode 318 and the common electrode being maintained, an orientation state of molecules of the liquid crystal 305 changes depending on an electrical field that is generated between the two electrodes. Therefore, if the liquid crystal element 320 is a transparent type, the transmittance thereof changes depending on the effective value of the maintained differential voltage. In the liquid crystal panel 992, since the transmittance varies for each liquid crystal element 320, the liquid crystal elements 320 are equivalent to pixels in the liquid crystal panel 992. Additionally, the number of scanning lines 312 (number of lines) and the number of data lines 314 (number of rows) are arbitrary, but here a configuration with 120 lines of scanning lines 312 and 160 rows of data lines 314 is used.

In this configuration, in addition to the scanning line driving circuit 996 applying a selected voltage to the scanning lines 312 and turning on (conduction) the TFT 316, the data line driving circuit 994 supplies a voltage data signal depending on gradation value to the pixel electrode 318 through the data lines 314 the TFT 316 that has been turned on. According to this configuration, the projector 100 can maintain a voltage depending on gradation value in the liquid crystal element 320 that corresponds to the intersection between the scanning lines 312 to which a selected voltage has been applied and the data lines 314 to which a data signal has been supplied.

Additionally, if the scanning lines 312 become non-selected voltages, the TFT 316 turns off (non-conduction), but since the off resistance at this time does not become infinite, the charge accumulated in the liquid crystal element 320 leaks considerably. In order to reduce the effect of this off to leakage, a storage capacitor (not shown) is formed for each pixel. While one end of the storage capacitor is connected to the pixel electrode 318 (the drain of the TFT 316), the other end of the storage capacitor is commonly connected to a storage capacitor line (not shown) across all of the pixels.

In addition, since degradation is prevented by applying a DC component to the liquid crystal 305, the voltage of the data signal is alternately switched between a positive polarity voltage on a high side and a negative polarity voltage on a low side with respect to a video amplitude center voltage (reference voltage) Vc for every predetermined fixed cycle (image processing unit, for example, a frame, a field, a line, a row etc.). Additionally, in order to prevent flickering, the abovementioned voltage Vcom is set to a value that is slightly lower than the reference voltage Vc. In addition, the voltage is a standard for when the ground potential of a power supply that has been omitted from the drawing is voltage zero.

In the present embodiment, as shown in FIG. 5, an example of a frame reversal method (surface reversal method) in which the polarity is reversed for each frame will be described. Additionally, in the frame reversal method, in addition to the same write-in polarity with respect to all pixels in the same frame period being specified, the write-in polarity is reversed for each frame period. In addition, as shown in FIG. 5, the abovementioned polarity determination signal Frp is at a high level (1) for positive polarity write-in and is at a low level (0) for negative polarity write-in. Therefore, the image processing circuit 940 can determine whether the write-in is positive polarity write-in or negative polarity write-in on the basis of the polarity determination signal Frp. Additionally, a field reversal method in which the polarity is reversed for each field and the like are practicable in a similar manner.

The scanning line driving circuit 996 sets a scanning signal G1 to a high level in the horizontal scanning period in which an image signal Vid that corresponds to the pixels of the first line is supplied, and sets a scanning signal G2 to a high level in the horizontal scanning period in which an image signal Vid that corresponds to the pixels of the second line is supplied. The same applies to the third line and so on. More specifically, as shown in FIG. 5, in addition to sequentially shifting the start pulse Dy depending on the clock signal Cly, the scanning line driving circuit 996 is configured to respectively supply a scanning signal G1, G2 etc. that has a pulse width that is narrowed to half the cycle of the clock signal Cly to the scanning lines 312 of the first line, the second line etc. Additionally, the high level of the scanning signal is a selected voltage that turns the TFT 316 on (conduction) and the low level of the scanning signal is a non-selected voltage that turns the TFT 316 off (non-conduction).

The data line driving circuit 994 respectively samples an image signal Vid that corresponds to the pixels of each line to each data line 314. In addition to sequentially shifting the start pulse Dx depending on the clock signal Clx, the data line driving circuit 994 is configured to output a sampling signal that has a pulse width that is narrowed to half the cycle of the clock signal Clx to correspond to each row and respectively samples the image signal Vid to the data lines 314 depending on the sampling signal.

Next, the write-in action for image display in the liquid crystal panel 992 will be described. The image signal Vide from the storage unit 120 (for example, frame memory or the like) is supplied to the image processing circuit 940 in the order of line 1, row 1 to line 1, row 160, line 2, row 1 to line 2, row 160 up to line 120, row 1 to line 120, row 160. Additionally, at least one frame of image data 122 is stored in the storage unit 120.

Here, in a frame (n frame) specified by positive polarity write-in, in the horizontal scanning period in which an image signal Vide of line 1, row 1 to line 1, row 160 is supplied, in addition to the image signal Vide being converted into a positive polarity image signal Vid by the image processing circuit 940, the image signal Vid is sampled to the data lines 314 of the $1^{st}$ to $160^{th}$ rows as the data signal by the data line driving circuit 994. Meanwhile, since due to the scanning line driving circuit 996, only the scanning signal G1 is at a high level, the first line of the TFT 316 is turned on. According to this configuration, since the data signal that was sampled to the data lines 314 is applied to the pixel electrode 318 through the TFT 316 that is turned on, a positive polarity voltage depending on respective gradation values is written into the liquid crystal element 320 of line 1, row 1 to line 1, row 160.

Next, in a similar manner, in the horizontal scanning period in which an image signal Vide of line 2, row 1 to line 2, row 160 is supplied, in addition to the image signal Vide being converted into a positive polarity data signal Vid, the data signal Vid is sampled to the data lines 314. Meanwhile, since only the scanning signal G2 is at a high level, the second line of the TFT 316 is turned on. According to this configuration, since the data signal that was sampled to the data lines 314 is applied to the pixel electrode 318, a positive polarity voltage depending on respective gradation values is written into the liquid crystal element 320 of line 2, row 1 to line 2, row 160. Thereafter, a similar write-in action is executed in the $3^{rd}$ to $120^{th}$ lines.

In the next (n+1) frame, apart from the image signal Vide being converted into a negative polarity data signal as a result of a reversal in the polarity determination signal Frp, a similar write-in action is executed. As a result of this, a negative polarity voltage depending on respective gradation values is written into the liquid crystal element 320. As a result of this kind of voltage write-in, in the liquid crystal panel 992, a data signal depending on the image signal Vide is written in and an image is displayed by display pixels.

Incidentally, in the TFT 316 disruption of the orientation of the liquid crystal occurs even at low voltages. Leakage of current of the signal to adjacent pixels and crosstalk due to the effect of the potential of the data lines 314 occurs. In addition, due to differences in the electrode material, the thickness of the orientation film and the like, there is asymmetric diversity of the characteristics (a difference in characteristics) of the element substrate and the counter substrate. This difference in characteristics is also a contributing factor to the effects related to crosstalk.

Figure 6:
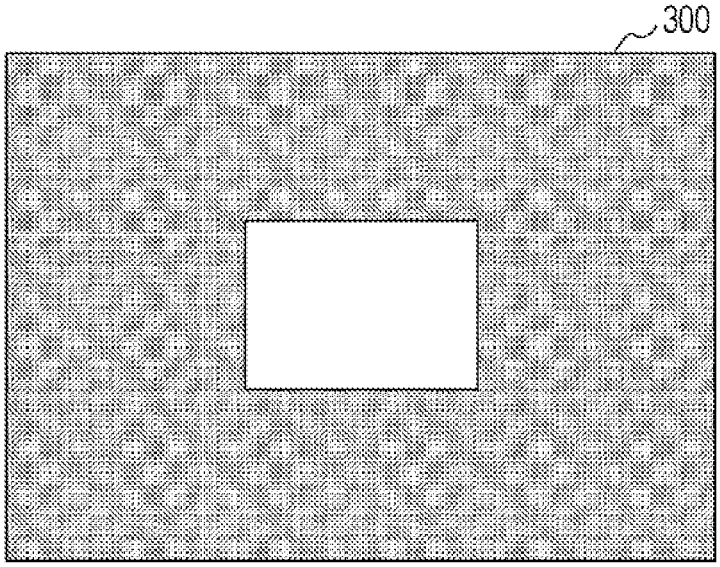
FIG. 6 is a view illustrating an example of an image in the first embodiment.
Figure 7:
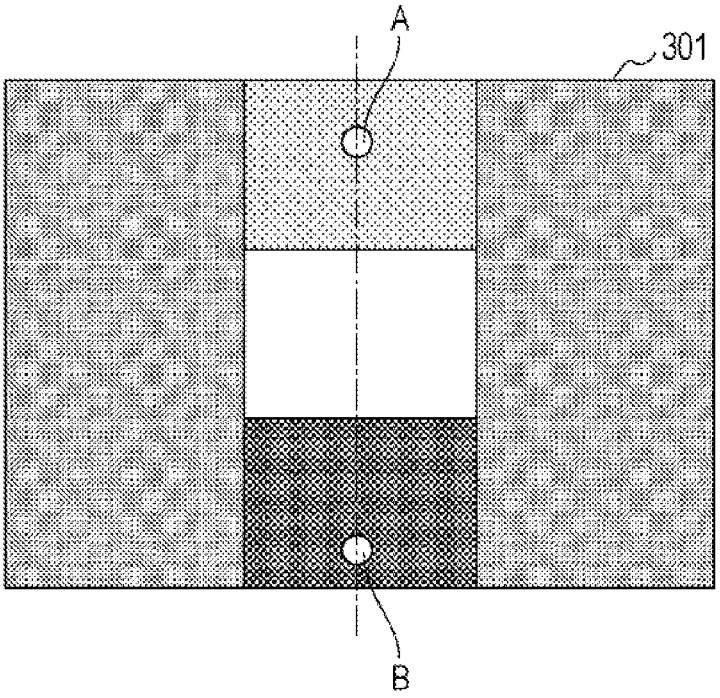
FIG. 7 is a view illustrating an example of an image in a state in which crosstalk has been generated in the first embodiment.

FIG. 6 is a view illustrating an example of an image 300 in the first embodiment. In addition, FIG. 7 is a view illustrating an example of an image 301 in a state in which crosstalk has been generated in the first embodiment. For example, in the original image 300, there are white rectangles in the center and the surrounding area thereof is a uniform grey area. If crosstalk is generated in this kind of image 300, as shown in image 301, the image can become an intermediate brightness between white and grey in a similar manner to the area of the pixel A portion and can become brightness that is darker than the grey of the surrounding area in a similar manner to the area of the pixel B portion. Additionally, in order to facilitate description FIG. 7 shows an extreme example.

Figure 8:
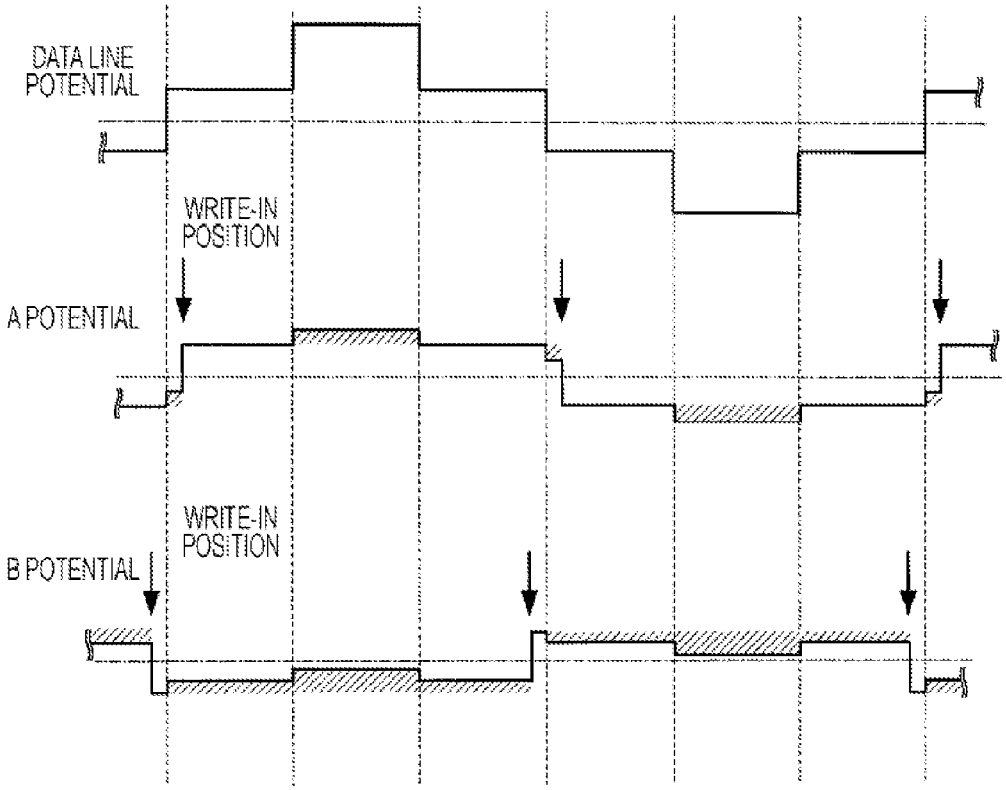
FIG. 8 is a view illustrating potentials in the first embodiment.

FIG. 8 is a view illustrating potentials in the first embodiment. The potentials of pixel A and pixel B are maintained from when write-in of the write-in positions shown in FIG. 8 has been performed until the write-in of the next write-in positions is performed. However, for example, in a case in which the potential of the data lines 314 of the portion shown by the dashed-dotted line in FIG. 7 changes in the manner shown in FIG. 8, even in a state in which the value is maintained by the abovementioned write-in, the potential of the pixel A and the potential of the pixel B can be pulled in a brighter direction or a darker direction than the original brightness as a result of receiving the effects of variations in potential of the data lines 314 by the data setting of the next pixel. For example, in FIG. 8, the shaded area is a portion that has changed as a result of receiving such effects. In addition, due to the abovementioned difference in characteristics, there are cases in which the extent of this pull differs as a result of the gradation and polarity. In addition to adjusting the extent of correction using a weighting depending on gradation value, the image processing circuit 940 of the present embodiment prevents the generation of crosstalk by eliminating the shaded portions in FIG. 8 through performing a calculation that uses a voltage value that shows gradation value.

Figure 9:
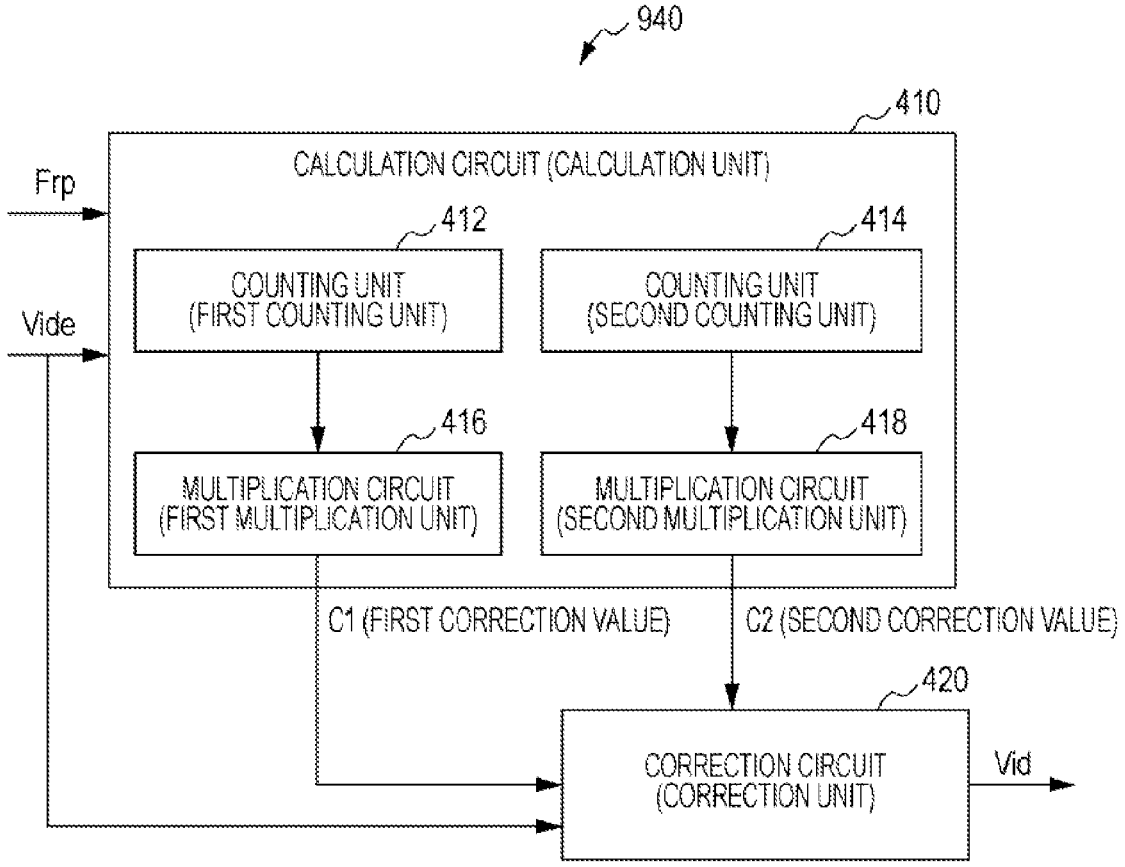
FIG. 9 is a circuit block diagram of an image processing circuit in the first embodiment.

Next this kind of function will be described in more detail. FIG. 9 is a circuit block diagram of an image processing circuit 940 in the first embodiment. The image processing circuit 940 is configured to include a calculation circuit (calculation unit) 410 into which the polarity determination signal Frp and the image signal Vide are input, and which outputs the first correction value C1 and the second correction value C2, and a correction circuit (correction unit) 420 into which the image signal Vide, the first correction value C1 and the second correction value C2 are input and which outputs the image signal Vid.

In addition, the calculation circuit 410 is configured to include a counting circuit (first counting unit) 412 which counts a value ST1 that corresponds to the gradation value of a first pixel group that has a gradation value that is greater than or equal to a first defined value, a counting circuit (second counting unit) 414 which counts a value ST2 that corresponds to the gradation value of a second pixel group that has a gradation value that is less than or equal to a second defined value that is less than or equal to the first defined value, a multiplication circuit (first multiplication unit) 416 which calculates a correction value C1 on the basis of the count value ST1 of the counting circuit 412, and a multiplication circuit (second multiplication unit) 418 which calculates a correction value C2 on the basis of the count value ST2 of the counting circuit 414. Additionally, the counting circuits 412 and 414 respectively have an internal memory in order to count ST1 and ST2. In addition, in the present embodiment the calculation circuit 410 performs calculation with the voltage value of the gradation value as a target.

Figure 10:
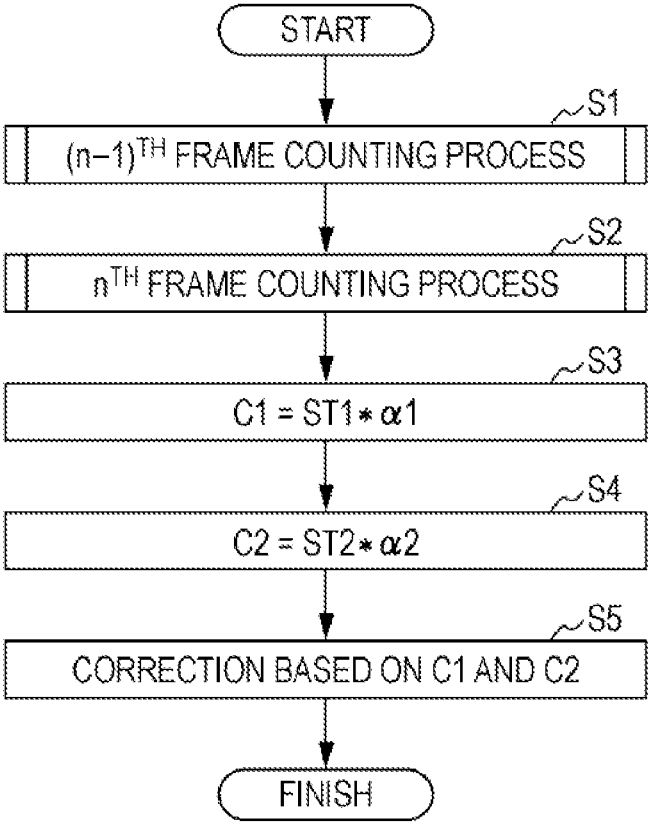
FIG. 10 is a flowchart illustrating an image processing sequence in the first embodiment.
Figure 11:
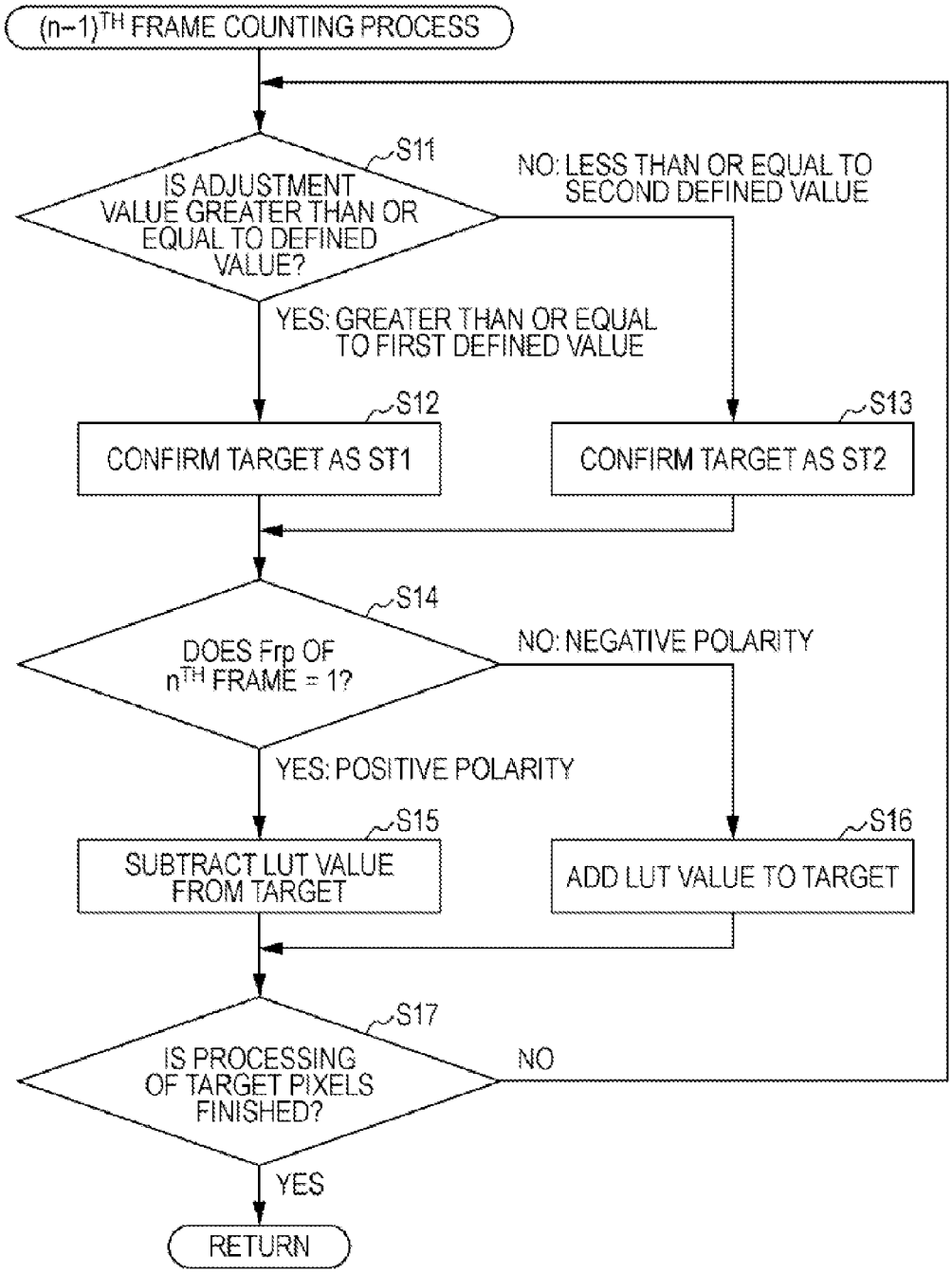
FIG. 11 is a flowchart illustrating a calculation processing sequence of an $(n-1)^{th}$ frame in the first embodiment.
Figure 12:
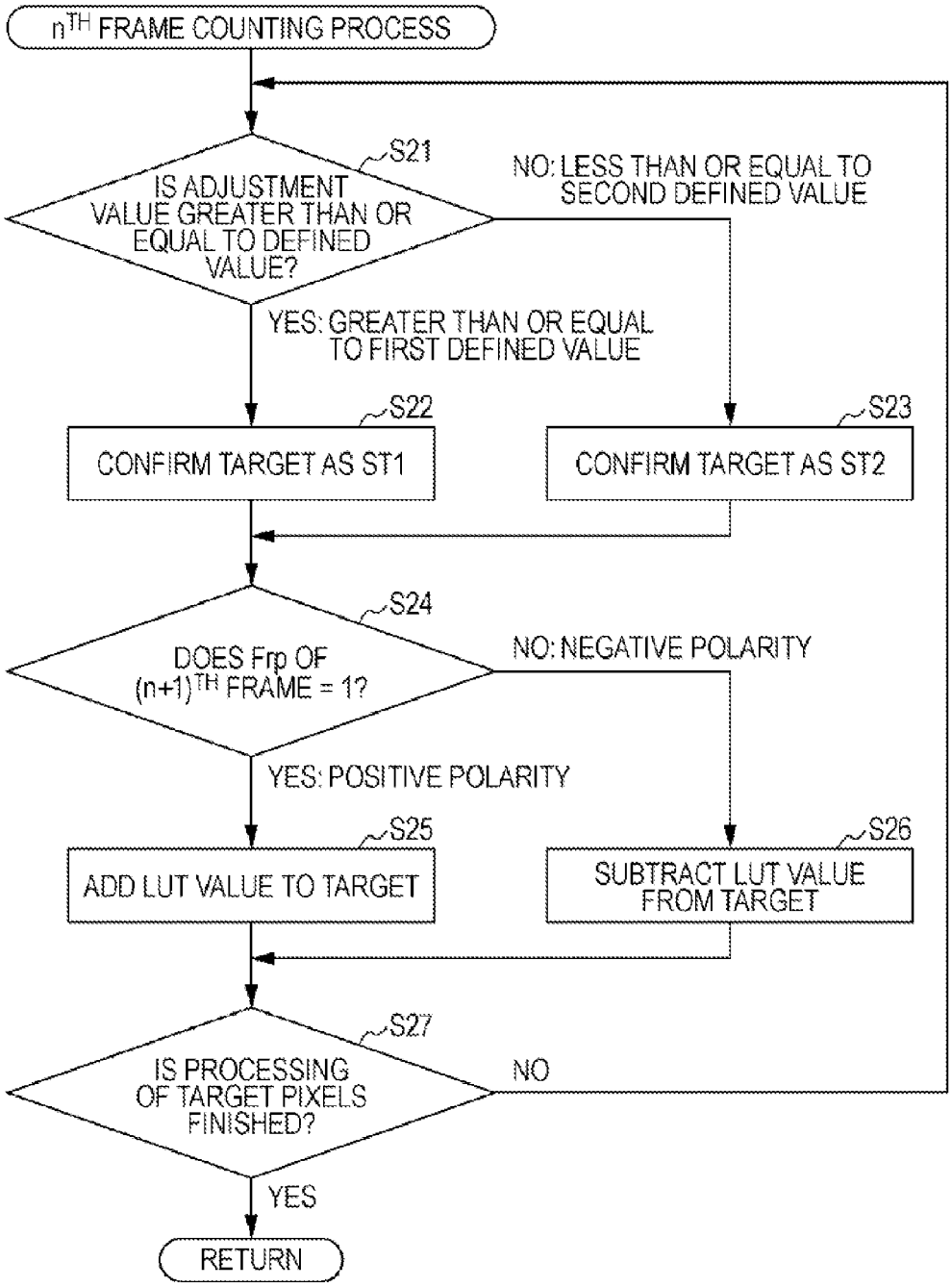
FIG. 12 is a flowchart illustrating a calculation processing sequence of an $n^{th}$ frame in the first embodiment.

Hereinafter, an image processing sequence using each of these units will be described. FIG. 10 is a flowchart illustrating an image processing sequence in the first embodiment. In addition, FIG. 11 is a flowchart illustrating a calculation processing sequence of an $(n-1)^{th}$ frame in the first embodiment. In addition, FIG. 12 is a flowchart illustrating a calculation processing sequence of an $n^{th}$ frame in the first embodiment. The counting circuits 412 and 414 are, for example, in a case in which the correction target pixel is a pixel in the $n^{th}$ frame, execute the counting process of the $(n-1)^{th}$ frame (step S1) and the counting process of the $n^{th}$ frame (step S2) and determine the first count value ST1 and the second count value ST2 for correcting the correction target pixel.

Figure 13:
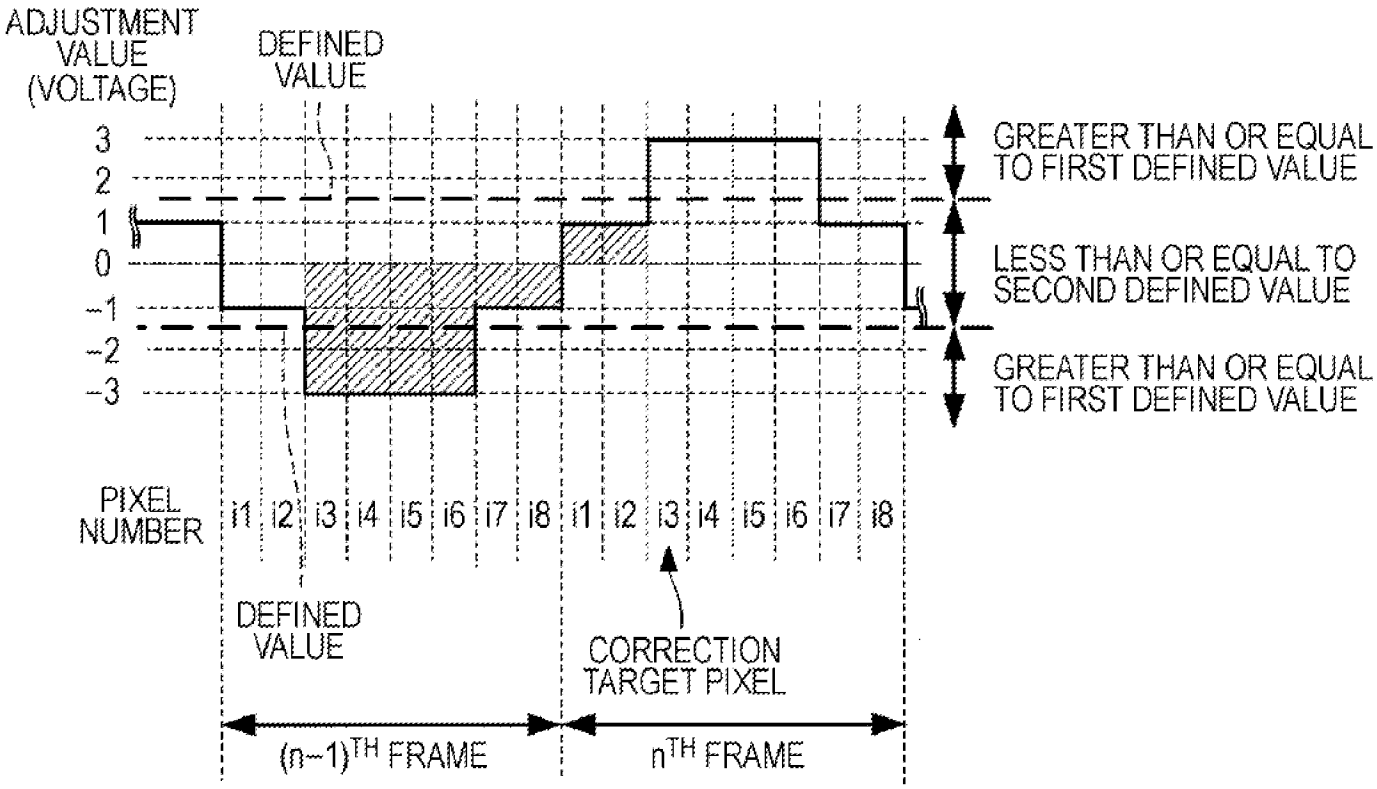
FIG. 13 is a view illustrating the gradation value for each pixel in the first embodiment as a voltage when the correction target pixel has a positive polarity.
Figure 14:
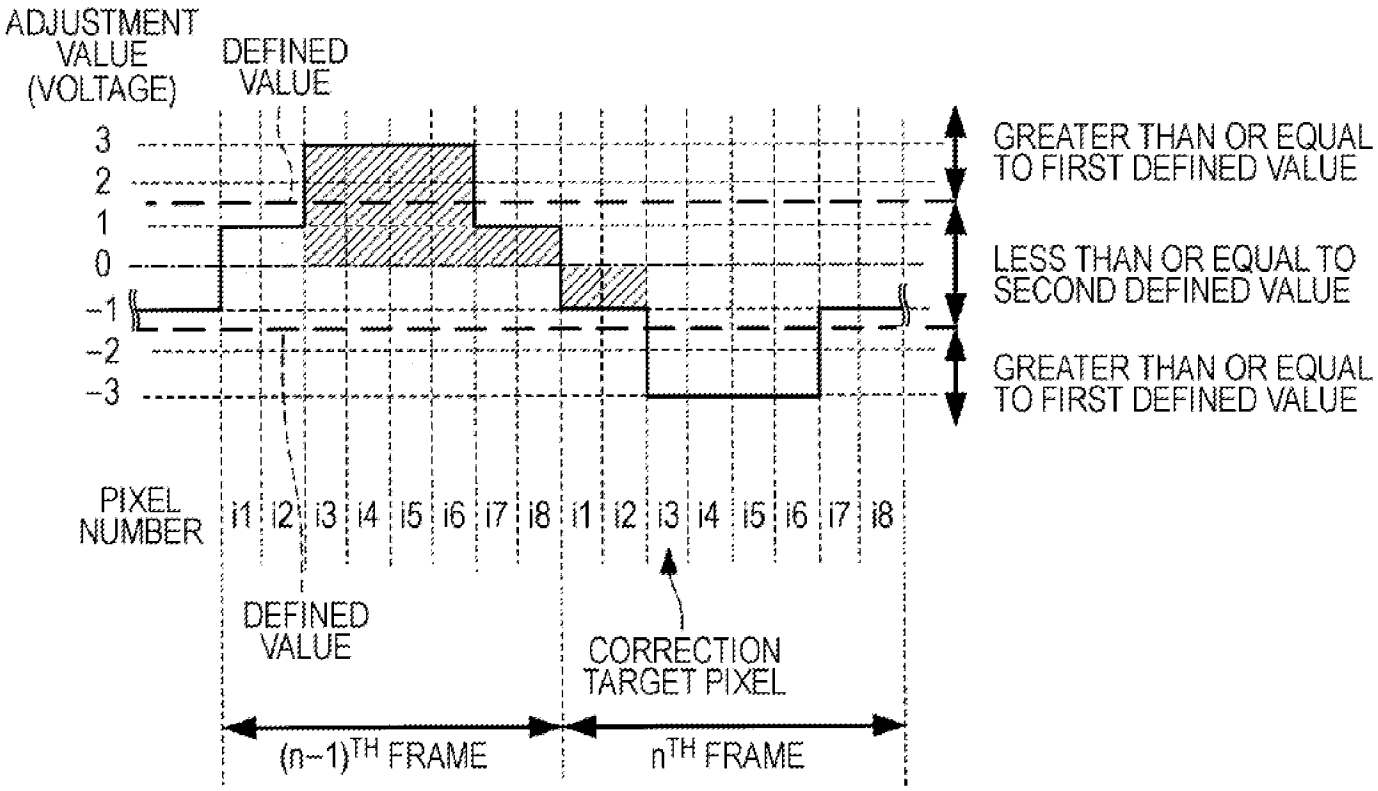
FIG. 14 is a view illustrating the gradation value for each pixel in the first embodiment as a voltage when the correction target pixel has a negative polarity.

FIG. 13 is a view illustrating the gradation values of each pixel in the first embodiment as voltages when the correction target pixel has a positive polarity. In addition, FIG. 14 is a view illustrating the gradation values of each pixel in the first embodiment as voltages when the correction target pixel has a negative polarity. For example, in a case in which the image 300 of FIG. 6 is displayed, the voltage of the gradation value of the row shown by the dashed-dotted line in FIG. 7 changes in the manner shown in FIGS. 13 and 14. As shown in FIGS. 13 and 14, the correction target pixel is a pixel in the $n^{th}$ frame. In addition, in the present embodiment, the first defined value=the second defined value (both referred to "defined value" below), and since the gradation value is expressed as a voltage, a positive or negative value can be set depending on the polarity and the absolute value of the gradation value and the abovementioned defined value can be compared. For example, in a case of a normally black method, the transmittance of the liquid crystal increases with an increase in voltage and the gradation value also increases, and in a case of a normally white method, the transmittance of the liquid crystal decreases with an increase in voltage and the gradation value also decreases. Additionally, the first defined value and the second defined value can be adjusted as appropriate according to the characteristics of the liquid crystal panel 992 and display method to which they are applied.

In addition, in order to facilitate description, the gradation values are simplified. For example, here, the defined value is set to be 1.5 in terms of absolute value (the thick dashed lines in FIGS. 13 and 14). Furthermore, 8 pixels (8 pixels that temporally precede the correction target pixel) that share a data line 314 in the same row as a correction target pixel configure the abovementioned pixel group. Additionally, in order to make description easier, 1 row is configured of 8 lines (8 pixels). That is, in a case in which a correction target pixel is a third pixel i3 of the $n^{th}$ frame, 6 pixels i3-i8 of the $(n-1)^{th}$ frame and 2 pixels i1 and i2 of the $n^{th}$ frame which are 8 pixels that correspond to a frame period from when the previous write-in of the corresponding pixel has been performed to when the write-in of the current pixel is performed, form the pixel group that is used in calculation.

Additionally, the image processing circuit 940 may perform correction of the gradation value of all of the pixels that configure the liquid crystal panel 992, may only perform correction of the gradation value of pixels that are effectively being displayed or may only perform correction of the gradation value of pixels other than those in the peripheral portion of the liquid crystal panel 992 in which crosstalk does not stand out.

Here, the counting process (step S1) of the $(n-1)^{th}$ frame will be described using FIG. 11. The calculation circuit 410 determines whether or not the gradation value is greater than or equal to the defined value for the 6 pixels i3-i8 of the $(n-1)^{th}$ frame (step S11). If the gradation value is greater than or equal to the defined value, the target is confirmed as ST1 and the counting circuit 412 performs counting (step S12). On the other hand, if the gradation value is less than the defined value, the target is confirmed as ST2 and the counting circuit 414 performs counting (step S13). For example, in the examples shown in FIGS. 13 and 14, the gradation value of pixels i3-i6 is 3 in terms of absolute value and since this is greater than or equal to the defined value of 1.5, the counting circuit 412 performs counting. In contrast to this, the gradation value of pixels i7 and i8 is 1 in terms of absolute value and since this is less than the defined value of 1.5, the counting circuit 414 performs counting.

In addition, the counting circuits 412 and 414 determine whether or not the polarity determination signal Frp of the $n^{th}$ frame is 1, that is, whether or not it is a positive polarity write-in (step S14). The counting circuits 412 and 414 subtract an LUT (Look Up Table) value (for example, a digitized integer of the effect on the pixel of the gradation value that is different from the gradation value or the like) depending on gradation value from the target (ST1 or ST2) (step S15) in the case of a positive polarity write-in and add an LUT value depending on gradation value to the target (ST1 or ST2) (step S16) in the case of a negative polarity write-in. Additionally, the counting circuits 412 and 414 set an LUT which shows the correspondence between the gradation values and the LUT values to be stored in the internal memory thereof. In addition, the gradation values and LUT values may have a one-to-one correspondence or may have a many-to-one (for example, range specification or the like) correspondence. If the correspondence is a many-to-one, it is possible to reduce the data occupation quantity of the LUT in the internal memory in comparison with a one-to-one correspondence.

The counting circuits 412 and 414 determine whether or not the counting process of target pixels is finished (step S17) and if the counting process is not finished, repeat execution of steps S11 to S17 until it is finished.

The counting process of the $n^{th}$ frame (step S2) is similar. The calculation circuit 410 determines whether or not the gradation value is greater than or equal to the defined value for the 2 pixels i9 and i10 of the $n^{th}$ frame (step S21). If the gradation value is greater than or equal to the defined value, the target is confirmed as ST1 and the counting circuit 412 performs counting (step S22). On the other hand, if the gradation value is less than the defined value, the target is confirmed as ST2 and the counting circuit 414 performs counting (step S23). For example, in the examples shown in FIGS. 13 and 14, the gradation value of pixels i1 and i2 of the $n^{th}$ frame is 1 in terms of absolute value and since this is less than the defined value of 1.5, the counting circuit 414 performs counting.

In addition, the counting circuits 412 and 414 determine whether or not the polarity determination signal Frp of the $(n+1)^{th}$ frame is 1, that is, whether or not it is a positive polarity write-in (step S24). The counting circuits 412 and 414 add an LUT value depending on gradation value to the target (ST1 or ST2) (step S25) in the case of a positive polarity write-in and subtract an LUT value depending on gradation value from the target (ST1 or ST2) in the case of a negative polarity write-in (step S26). Additionally, the polarity determination signal of the $n^{th}$ frame and the polarity determination signal Frp of the $(n+1)^{th}$ frame are input at the time of input of the image signal Vide of the $n^{th}$ frame. In addition, in a case of the frame reversal method of the present embodiment, the counting circuits 412 and 414 may process the opposite polarity of the polarity determination signal of the $n^{th}$ frame as the polarity determination signal of the $(n+1)^{th}$ frame.

The counting circuits 412 and 414 determine whether or not the counting process of target pixels is finished (step S27) and if the counting process is not finished, repeat execution of steps S21 to S27 until it is finished.

The counting circuit 412 writes the ST1 determined in this manner to the internal memory thereof and the counting circuit 414 writes ST2 to the internal memory thereof. For example, in the state shown in FIG. 13, a case in which the gradation value is counted as it is, is considered. In such a case, the gradation value of 4 pixels i3-i6 of the $(n-1)^{th}$ frame is −3 (3 in terms of absolute value) and is therefore greater than or equal to the defined value of 1.5, and since the Frp of the $n^{th}$ frame=1, ST1=−(−3)×4=12. In addition, in such a case, the gradation value of 2 pixels i7 and i8 of the $(n-1)^{th}$ frame is −1 (1 in terms of absolute value) and since the Frp of the $n^{th}$ frame=1, ST2=−(−1)×2=2. Furthermore, the gradation value of 2 pixels i1 and i2 of the $n^{th}$ frame is 1 and is less than the defined value of 1.5, and since the Frp of the $(n+1)^{th}$ frame=0, ST2=ST2−(1)×2=2−2=0.

The multiplication circuit 416 determines a first correction value C1 by multiplying the count value ST1 from the counting circuit 412 by a coefficient α1 (step S3). In addition, the multiplication circuit 418 determines a second correction value C2 by multiplying the count value ST2 from the counting circuit 414 by a coefficient α2 (step S4). Additionally, the coefficient α1 and the coefficient α2 are values that are different from each other and can be adjusted as appropriate according to the characteristics of the liquid crystal panel 992 and the like to which they are applied.

The correction circuit 420 corrects the image signal Vide of the correction target pixels on the basis of the correction value C1 and C2 and converts the image signal into an analogue format image signal Vid (step S5). More specifically, for example, the correction circuit 420 adds an added value of the correction value C1 and C2 to the gradation value of a correction target pixel. Additionally, in a practical sense, in order to prevent over-correction, rather than changing the gradation value of a correction target pixel to a great extent, the gradation value thereof is changed to a minor extent. In addition, after the image processing of pixel i3 of the $n^{th}$ frame, a similar image processing is executed on the next pixel i4 of the $n^{th}$ frame and a similar image processing is executed on the $(n+1)^{th}$ frame onward and so on. That is, even with respect to the same pixel, the gradation value (the voltage value by which the pixel is driven) is corrected respectively during positive polarity driving and negative polarity driving.

In the manner described above, according to the present embodiment, a projector 100 can further reduce the generation of crosstalk by correcting image data related to a correction target pixel by performing calculations of counting, multiplying and the like with weightings that are changed depending on the gradation value of the pixel group, which are the main cause of crosstalk generation. In addition, according to the present embodiment a projector 100 can perform a calculation which more suitably reflects the characteristics of the gradation value of each pixel group by performing a first calculation on a first pixel group and performing a second calculation that does not overlap with the first pixel group on a second pixel group.

In addition, according to the present embodiment, since it is also possible to suitably perform correction in a case in which the change in the positive potential and the change in the negative potential differ in the same pixel in a case in which polarity reversal driving is performed by performing calculation using voltage values of gradation values, a projector 100 can more suitably reduce the generation of crosstalk. Furthermore, according to the present embodiment, since it is possible to adjust correction data by adjusting the symbol depending on polarity, in addition to more suitably reducing the generation of crosstalk, a projector 100 can perform a post-processing after adjustment more easily.

Other Embodiments

Additionally, the application of the present invention is not limited to the embodiment described above and modifications may be made. For example, the counting circuits 412 and 414 may use a shared LUT stored in the storage unit 120, may use correction data other than an LUT or may use a function that outputs a value that corresponds depending on the input of the gradation value or the like. In addition, instead of an LUT value, the counting circuits 412 and 414 may output a count value of the actual gradation value of the target pixel group to the multiplication circuits 416 and 418.

In addition, the calculation method of the calculation circuit 410 is not limited to the calculation method of the embodiment described above. For example, the counting circuits 412 and 414 may count a value obtained by subtracting the effective gradation value from the maximum gradation value (for example, 255 in the case of 8-bit) which is possible as a value. According to this configuration, the calculation circuit 410 can prevent the occurrence of a situation in which, for example, in a case in which the effective gradation value is 0, the count value is 0, the multiplication result of the multiplication circuits 416 and 418 is also 0 and correction is not performed. In addition, the multiplication circuits 416 and 418 may use the current gradation value of the correction target pixel and a value obtained by subtracting the current gradation value of the correction target pixel from the maximum gradation value which is possible as a value as the abovementioned coefficients α1 and α2. Furthermore, the calculation circuit 410 may not execute a process (steps S14 to S16 and S24 to S26) depending on the polarity determination signal Frp. For example, the counting circuits 412 and 414 may output the counted gradation values as they are to the multiplication circuits 416 and 418.

In addition, the counting circuits 412 and 414 use pixels in the same frame as the correction target pixel and pixels in the frame before, but may use pixels in the same frame as the correction target pixel and pixels in the frame after, or pixels in the same frame as the correction target pixel only. For example, the image processing unit 140 may use pixels in a frame the frame before in a case of processing a dynamic image in order to prevent delayed display, but may also use pixels in a frame after in a case of processing a static image since delayed display is rarely a problem. In addition, the number of pixels that configure the pixel group which is used in the abovementioned counting is not limited to 8 and may be 7 or less, or greater than or equal to 9. Furthermore, the correction target pixel is not limited to one and may be a pixel block or the like configured by a plurality of pixels.

In addition, in the embodiment described above, an image processing method that prevents the generation of vertical crosstalk is described, but the present invention is also effective in a case of preventing horizontal crosstalk in a horizontal direction. For example, the image processing unit 140 may correct image data 122 on the basis of the gradation value of a pixel group having common correction target pixels and scanning lines 312. In addition, the embodiment described above is an example of polarity reversal driving, but the present invention is also effective in driving methods that are not polarity reversal driving.

In addition, in the embodiment described above, the first defined value and the second defined value are equivalent, but the second defined value may be a value that is less than the first defined value. For example, in the state of FIG. 13, if the first defined value is 2 and the second defined value is 0.5, the pixels i3-i6 of the $(n-1)^{th}$ frame correspond to the condition of being greater than or equal to the first defined value and can be used in the abovementioned calculation. However, since the pixels i7 and i8 of the $(n-1)^{th}$ frame and the pixels i1 and i2 of the $n^{th}$ frame do not correspond to the conditions of being greater than or equal to the first defined value and less than or equal to the second defined value, the foregoing cannot be used in the abovementioned calculation. Additionally, in such a case, in the state of FIG. 13, there aren't any pixels that correspond to the condition of being less than or equal to the second defined value. That is, the calculation circuit 410 may perform the abovementioned calculation using the gradation value of a portion of pixels having common correction target pixels and data lines 314.

In addition, the second defined value may be a value that more than the first defined value. For example, in the state of FIG. 13, if the first defined value is 0.5 and the second defined value is 2, the pixels i3-i8 of the $(n-1)^{th}$ frame and the pixels i1 and i2 of the $n^{th}$ frame correspond to the condition of being greater than or equal to the first defined value and can be used in the abovementioned calculation, and the pixels i7 and i8 of the $(n-1)^{th}$ frame and the pixels i1 and i2 of the $n^{th}$ frame correspond to the conditions of being less than or equal to the second defined value and can be used in the abovementioned calculation. That is, the calculation circuit 410 may perform the abovementioned calculation by overlapping and using the gradation values of the same pixels that have common correction target pixels and data lines 314.

In addition, the calculation circuit 410 may perform determination based on 3 or more defined values and calculate correction values with respectively weightings that are respectively changed depending on count values or the like that corresponds to the respective conditions. In addition, in FIG. 13 and the like, the gradation values are displayed as voltages, but in a case in which the gradation values themselves are used, rather than being absolute values, the defined values may be positive values. That is, the calculation circuit 410 or the like may perform the abovementioned calculation and comparison of defined values using the gradation values themselves.

In addition, the image processing apparatus (image processing unit 140) is not limited to mounting in the projector 100 and can be mounted in a liquid crystal display device included in a car navigation device, a digital camera or the like, a liquid crystal monitor connected to a PC (Personal Computer) or the like, or another image display apparatus such as a television, an HMD (Head Mounted Display), a smartphone, or a mobile phone. In addition, the projector 100 is not limited to a liquid crystal projector (a transmission type or a reflective type such as an LCOS) and for example, may be a projector that uses a digital micromirror device or the like. In addition, the projector 100 is not limited to a three mirror projector and may be a single mirror projector.

This application claims priority to Japan Patent Application No. 2011-285074 filed Dec. 27, 2011, the entire disclosures of which are hereby incorporated by reference in their entireties.

What is claimed is:

1. A driving device of a display apparatus comprising:

a data line;

n (n is a positive integer greater than or equal to 3) scanning lines that each intersect the data line;

n pixels, each of the n pixels corresponding to a separate scanning line of the n scanning lines, each of the n pixels disposed to correspond to the intersection of the data line and the corresponding scanning line, wherein, the driving device includes a calculation unit which calculates a correction value to correct a gradation value of a correction target pixel among the n pixels; and a correction unit which corrects the gradation value of the correction target pixel on the basis of the correction value, and wherein the calculation unit performs a first calculation for each gradation value of m (m is a positive integer smaller than or equal to n) pixels among the n pixels in a first range, and performs a second calculation that is different from the first calculation for each gradation value of n−m (n minus m) pixels among the n pixels in a second range that is different from the first range, wherein the first calculation multiplies by a first coefficient, the second calculation multiplies by a second coefficient that is different from the first coefficient, the calculation unit performs one of the first calculation and the second calculation for each of a first group of pixels of the n pixels that belong to a first frame, the calculation unit performs one of the first calculation and the second calculation for each of a second group of pixels of the n pixels that belong to a second frame that either precedes or follows the first frame, the second group of pixels comprising different pixels than the first group of pixels, and the calculation unit calculates the correction value of the correction target pixel based on each of the first calculations and the second calculations for both the first group of pixels and the second group of pixels.

2. The driving device of a display apparatus according to claim 1, wherein the calculation unit multiplies the gradation value of each pixel for which the first calculation is performed by a first coefficient, and multiplies the gradation value of each pixel for which the second calculation is performed by a second coefficient that is different from the first coefficient.

3. The driving device of a display apparatus according to claim 1, further comprising:

an output unit that outputs a voltage signal that respectively corresponds to the n gradation values, outputs a positive polarity voltage that is on a high side of a reference voltage as the voltage signal in the first frame, and outputs a negative polarity voltage that is on a low side of the reference voltage as the voltage signal in the second frame that follows the first frame.

4. The driving device of a display apparatus according to claim 3, wherein the calculation unit performs calculation by assigning one of a positive or a negative symbol to the first gradation value and the second gradation value in the first frame, and performs calculation by assigning the other of a positive or a negative symbol to the first gradation value and the second gradation value in the second frame.

5. The driving device of a display apparatus according to claim 1, wherein in a case in which the correction target pixel among the n pixels is an $m^{th}$ (m is a positive integer) pixel, the calculation unit performs the first calculation or the second calculation from the first pixel to the $m-1^{th}$ pixel that belong to the same frame as the $m^{th}$ pixel and from the $m^{th}$ pixel to the $n^{th}$ pixel that belong to the frame before the $m^{th}$ pixel.

6. The driving device of a display apparatus according to claim 1, wherein in a case in which the correction target pixel among the n pixels is an $m^{th}$ (m is a positive integer) pixel, the calculation unit performs the first calculation or the second calculation from the $m+1^{th}$ pixel to the $n^{th}$ pixel that belong to the same frame as the $m^{th}$ pixel and from the first pixel to the $m^{th}$ pixel that belong to the frame after the $m^{th}$ pixel.

7. A display apparatus including the driving device of a display apparatus according to claim 1.

8. A projector including the display apparatus according to claim 7.

9. An electronic apparatus including the display apparatus according to claim 7.

10. The driving device of a display apparatus according to claim 1, wherein the calculation unit:

calculates a first correction value to correct a gradation value of a first correction target pixel among the n pixels by counting each of the calculation results of the n calculation results performed by the first calculation, and calculates a second correction value to correct a gradation value of a second correction target pixel among the n pixels by counting each of the calculation results of the n calculation results performed by the second calculation.

11. The driving device of a display apparatus according to claim 1, wherein the calculation unit calculates the correction value of the correction target pixel by adding a first result of the first calculation to a second result of the second calculation.

12. The driving device of a display apparatus according to claim 1, wherein the correction value is not utilized to correct gradation values of each of the n pixels.

13. The driving device of a display apparatus according to claim 1, wherein the correction value is utilized to correct only the gradation value of the target pixel of the n pixels.

14. The driving device of a display apparatus according to claim 1, wherein the target pixel is included in either the first group of pixels or the second group of pixels.

* * * * *